US007946764B2

(12) United States Patent
Sulpizio et al.

(10) Patent No.: US 7,946,764 B2
(45) Date of Patent: May 24, 2011

(54) EXPANDABLE BAG ASSEMBLIES WITH AN INTEGRAL SUPPORT STRUCTURE FOR FILLING

(75) Inventors: Alfred Sulpizio, Philadelphia, PA (US); John Funk, Evergreen, CO (US); Ian Barclay, Marion, NY (US)

(73) Assignee: Evergreen Innovation Partners I, LP, Englewood, CO (US)

( * ) Notice: Subject to any disclaimer, the term of this patent is extended or adjusted under 35 U.S.C. 154(b) by 924 days.

(21) Appl. No.: 11/746,591

(22) Filed: May 9, 2007

(65) Prior Publication Data

US 2008/0131034 A1 Jun. 5, 2008

Related U.S. Application Data

(60) Provisional application No. 60/872,154, filed on Nov. 30, 2006.

(51) Int. Cl.
*B65D 33/00* (2006.01)
*B65D 30/16* (2006.01)
*B65D 33/02* (2006.01)

(52) U.S. Cl. ..... 383/33; 383/104; 383/105; 383/119

(58) Field of Classification Search ..... 383/33–34.1, 383/104, 105, 119; 220/495.11, 9.2–9.4
See application file for complete search history.

(56) References Cited

U.S. PATENT DOCUMENTS 608,998 A * 8/1898 Apthorp ..... 220/9.2
2,295,584 A 9/1942 Larson
2,342,324 A 2/1944 Allen
2,406,678 A * 8/1946 Gerahty ..... 156/198
2,474,273 A * 6/1949 Olson ..... 2/167
2,494,446 A 1/1950 Moore
2,556,321 A 6/1951 Denton
2,636,656 A * 4/1953 Tanabe ..... 141/314
2,773,636 A 12/1956 Williams et al.
2,873,905 A 2/1959 Denton
3,249,286 A 5/1966 Palmer
3,262,629 A 7/1966 Murphy et al.
3,822,524 A * 7/1974 Jerpbak ..... 53/459
3,896,991 A 7/1975 Kozlowski et al.
3,902,541 A * 9/1975 Wardwell ..... 383/72

(Continued)

FOREIGN PATENT DOCUMENTS

GB 2240088 7/1991

OTHER PUBLICATIONS

International Search Report and Written Opinion for PCT/US2007/084661; Evergreen Innovation Partners I, LP; Apr. 7, 2008, pp. 1-16.

*Primary Examiner* — Jes F Pascua

(57) ABSTRACT

Expandable bag assemblies and associated methods are disclosed herein. Certain aspects of the invention are directed toward an expandable bag assembly that includes a flexible bag with closed and open ends and collapsible sidewalls disposed between the ends. The assembly beneficially includes an integrated support structure provided with stiffeners and a mechanism for attachment to help hold a mouth of the bag in an open position while filling the bag. The assembly can be compressed for easy packaging and storage and be expanded into a self-supported, open position without memory folds. The assembly is also configured to retract during closure of the open end of the bag.

38 Claims, 10 Drawing Sheets

U.S. PATENT DOCUMENTS 3,915,329 A 10/1975 Zaks
3,957,195 A 5/1976 Lin
4,064,302 A 12/1977 Kozlowski et al.
4,064,969 A * 12/1977 Black ..... 184/1.5
4,284,205 A 8/1981 Hirata
4,317,478 A 3/1982 Babbidge
4,334,660 A * 6/1982 Zeigler ..... 248/97
4,457,483 A 7/1984 Gagne
4,628,007 A 12/1986 Ledsham
4,664,348 A 5/1987 Corsaut, III et al.
4,705,248 A * 11/1987 McIntyre ..... 248/99
4,738,286 A * 4/1988 McIntyre ..... 141/10
4,764,029 A * 8/1988 Abblett ..... 383/104
4,940,200 A 7/1990 Sawyer et al.
4,941,754 A * 7/1990 Murdock ..... 383/3
5,037,138 A 8/1991 McClintock et al.
5,048,977 A * 9/1991 Robbins, III ..... 383/104
5,056,679 A 10/1991 Lonczak
5,082,219 A 1/1992 Blair
5,132,124 A 7/1992 Tamaki et al.
5,314,250 A * 5/1994 Lee ..... 383/3
5,425,468 A 6/1995 Birkel et al.
5,593,117 A 1/1997 Alexander, III
5,597,022 A * 1/1997 Reifers ..... 141/390
5,743,651 A 4/1998 Steinmetz
5,871,037 A * 2/1999 Feldt ..... 141/391
5,897,084 A 4/1999 Judge
5,967,357 A * 10/1999 Kellogg et al. ..... 220/9.2
6,149,025 A * 11/2000 Wang ..... 220/6
6,164,453 A * 12/2000 Perkins ..... 206/596
6,494,619 B1 12/2002 Sulpizio
6,669,045 B2 * 12/2003 Wang ..... 220/9.2
2005/0284866 A1 12/2005 Oakner et al.
2006/0188179 A1 8/2006 Schlipper
2008/0056625 A1 3/2008 Stanton et al.

* cited by examiner 126
116
128
902
906

126
904

126

126

126

126

EXPANDABLE BAG ASSEMBLIES WITH AN INTEGRAL SUPPORT STRUCTURE FOR FILLING

CROSS-REFERENCE OF RELATED APPLICATION

The present application claims priority to U.S. Provisional Application Ser. No. 60/872,154, filed Nov. 30, 2006, the disclosure of which is incorporate herein by reference in its entirety.

TECHNICAL FIELD

The present invention is directed to collapsible bags with integrated support structures for aid in filling, and specifically, to disposable bags with structures to help hold the bag in an open position while filling.

BACKGROUND

Bags of all shapes and sizes are widely used for purposes ranging from item transport and storage to collection and removal of trash and recyclables. Bags commonly used to collect debris and garbage for disposal purposes are convenient to use due to their transportability and the disposable materials used in their manufacture. Although disposable bags are convenient for trash collection, they are flexible and unsupported so they generally require a trash can or other frame structure to hold the trash bag open. When a trash can or other support is not used in conjunction with the trash bag, holding the trash bag open while filling can be very cumbersome and difficult.

Performing clean-up chores may be extraneously laborious when the bags collapse or require manipulation to open the bag for inserting the disposed material. For example, a user often must hold the trash bag open with one hand while trying to deposit the trash or other items into the bags with the other hand. For large or loose items, such as those generated in outdoor yard work, it is difficult to hold open the bag during the filling process. Additionally, for waste generated while cooking in the kitchen or other countertop projects requiring use of hands, such as changing a baby, it is desirable to have the disposal bag close and secured in an open position for ease and safety.

While the use of trash cans or receptacles may be conveniently used to support a deposable bag in an open position in more permanent locations, the use of cans or other frame supports are often disadvantageous and frustrating to use. For example, frame supports or cans are often sized to support one type or size of bag. When different sized bags are used, the support offered is often counterproductive in that when the bag is too small for the support, the mouth of the bag collapses to a closed position or the bag falls useless to the bottom of the can. When the bag is oversized for the frame or can, the filling capacity of the bag is compromised and much of the bag is underutilized. Furthermore, when a bag is filled within a frame or can, it can expand against the walls of the receptacle and be difficult to remove or easily torn during disposal. Additional drawbacks of using separate support frames for disposable bags are the inconvenience of transport of the frames or the number of frames required for some projects. It may also be inconvenient or unsanitary to have frames or cans sitting on countertop surfaces for refuse generated locally in these locations.

Other collapsible bags have been used for a variety of temporary or long term storage purposes. For example collapsible laundry bags are used for collecting and transporting dirty or clean laundry. The collapsible laundry bags, however, require a user to "stuff" the dirty or clean linens into the bag causing extra work for the collection of dirty linens and unnecessary wrinkling of clean linens. For example, many people prefer to fold clothes and linens directly from the dryer to prevent wrinkles. A laundry basket allows the folded items to be preserved in a non-wrinkled state, however, the bag is preferred in many cases over the basket when a user wants to keep the items clean or there is limited space.

In attempts to remedy these problems, a number of devices that hold the mouth of the bags open have been developed. Generally, these devices are not ideal in that they are fabricated and packaged separately from the bag, such that their transport, accessibility, and the number of devices required for a particular project remain inconveniences for the user. Additionally, the devices must be removed/recovered from the bag prior to securing the top end of the bag for disposal or storage.

Other devices in the prior art have been developed to be integrally attached to the bag, such as a strip of stiff material positioned around the mouth of the bag to coax it into an open position. However, these prior art devices have experienced difficulties in practice, such as with foldability of the bags for packaging and storage, and with memory of the folded position that prevents the bags from remaining in a fully expanded, open position. These bag structures have additional problems when using closure devices, such drawstrings, for securing the completely or partially filled bag in a closed position. Specifically, due to the rigidity of a support collar around the opening of the bag, the drawstring or other closure device cannot consistently and efficiently collapse the opening's circumference because of the pull on the rigid structure of the support collar.

Therefore, a need exists for a collapsible bag with integrated support structures for aid in filling, and specifically, for a disposable bag with disposable structures to help hold the bag in an open position and easily retract for bag closure that overcomes the disadvantages of the prior art. From the foregoing discussion, it should be apparent that a need exists for an assembly that allows a user to easily package, store, and transport a collapsible bag and when desired, expand, fill and reclose the collapsible bag without the need to attach or implement an additional support frame.

SUMMARY

The present invention has been developed in response to the present state of the art, and in particular, in response to the problems and needs in the art that have not yet been fully solved by currently available disposable bags. Accordingly, the present invention has been developed to provide expandable bag assemblies with integral support structures to help hold the bags in an open position while filling the bags overcoming shortcomings in the art and providing other benefits.

One aspect of the invention is directed toward an expandable bag assembly with support aid for filling the bag assembly. The assembly comprises a flexible bag having a closed end portion, an open end portion, and collapsible sidewalls that define an internal cavity. The open end portion defines a mouth of the bag and is moveable to an open position to receive fill material into the internal cavity and moveable to a closed position. One or more stiffeners are attached to the sidewalls of the bag. Each of the stiffeners is adjacent to other ones of the stiffeners and is moveable relative to the adjacent ones of the stiffeners. The stiffeners define a positionable self-supporting structure configured to define a portion of the internal cavity proximate to the mouth of the bag and to retain the mouth of the bag and the portion of the internal cavity in the open position to receive fill material therein.

In another embodiment, a disposable bag assembly is provided that comprises a body portion having a first longitudinal axis, an internal cavity, and sidewalls. The body portion has an open end portion that defines a mouth of the bag that is moveable to an open position to receive fill material into the internal cavity and that is moveable to a closed position. One or more stiffeners are attached to the sidewalls of the bag proximate to the open end portion. The stiffeners have a second longitudinal axis and are moveable with a portion of the flexible sidewall relative to the adjacent ones of the stiffeners. Each of the stiffeners are corrugated with ridges substantially parallel to the second longitudinal axis. The stiffeners form a conformable, self-supporting structure configured to be positionable to retain the mouth of the bag and the portion of the internal cavity in the open position to receive fill material therein.

In another embodiment, a disposable bag assembly is provided that comprises a flexible bag having a closed end and open end. An integrated support structure has a plurality of stiffeners spaced apart from each other and configured to hold and maintain the open end of the bag assembly in a self-supporting open fillable position. The plurality of stiffeners are configured to fold with the flexible bag to form a substantially planar configuration such that the plurality of stiffeners are aligned to form a compact stack when the bag and stiffeners are in a folded condition.

DETAILED DESCRIPTION

The present disclosure describes expandable bag assemblies with integral support structures. Several specific details of the invention are set forth in the following description and in FIGS. 1-15 to provide a thorough understanding of certain embodiments of the invention. One skilled in the art, however, will understand that the present invention may have additional embodiments, and that other embodiments of the invention may be practiced without several of the specific features described below.

Figure 1A:
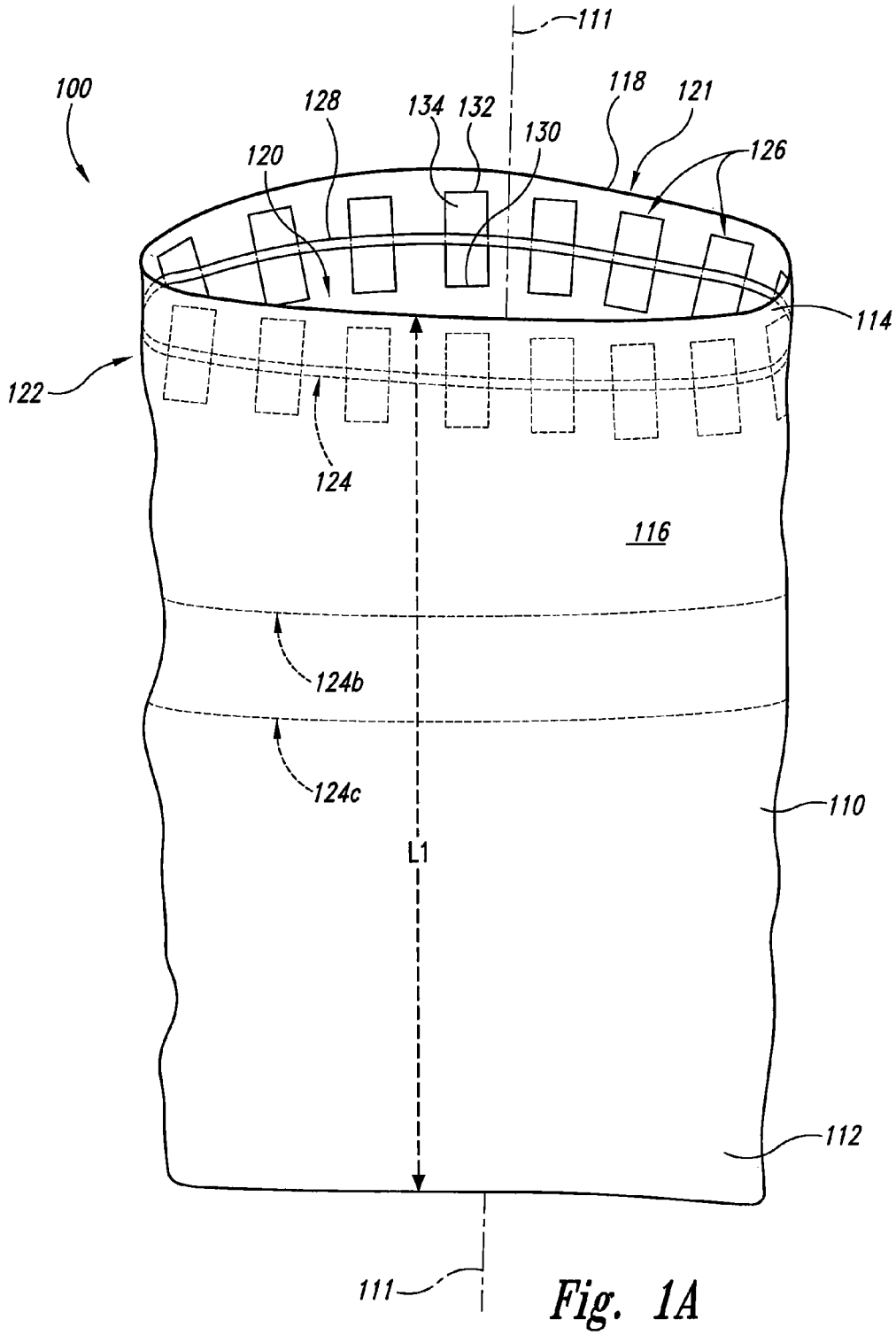
FIG. 1A is an isometric view of an expandable bag assembly in accordance with an embodiment of the invention shown in a fully extended, open position.

FIG. 1A shows an isometric view of an expandable bag assembly 100 in a fully extended, open position in accordance with an embodiment of the invention. The assembly 100 includes a flexible bag 110 with a closed end 112, an open end 114, and collapsible sidewalls 116 with length $L_1$ that form the bag between the closed and open ends 112 and 114. The open end 114 provides the bag 110 with a mouth 118 configured to receive items into an internal cavity 120 within the bag 110. The internal cavity 120 has a fillable volume 121 defined by the collapsible sidewalls 116, the closed end 112 and the open end 114.

The assembly 100 also includes a self-supporting support structure 122 integrated with a perimeter 124 of the bag 110 proximal to the open end 114. In other embodiments, the perimeter 124 to which the support structure 122 is attached may be positioned at perimeters 124*b*, 124*c*. One of ordinary skill in the art will appreciate that the place of attachment of the support structure 122 may be at a perimeter 124 at other positions between the closed end 112 and the open end 114.

The support structure 122 of the illustrated embodiment comprises a plurality of stiffeners 126 attached to the collapsible sidewalls 116 around the perimeter 124. The stiffeners 126 are bonded, adhered, or otherwise coupled to the sidewalls 116 by a mechanism for attachment 128 (explained in more detail below). In one embodiment, the stiffeners 126 are generally planar and have lower edge portions 130 and upper edge portions 132 spaced apart from each other. When the assembly 100 is in a filling position with an expanded mouth 118, the stiffeners 126 may be oriented essentially parallel to the longitudinal axis 111 of the bag 110 such that the lower edge portions 130 can sit on a resting surface so the self-supporting support structure holds the mouth in the open position. In one embodiment, the stiffeners may be perforated to reduce stiffeners' bending stiffness (which increases foldability) while still maintaining axial rigidity.

The bag 110 may be formed from one or more flexible materials such that the bag 110 may be folded or rolled to a compact form for efficient packaging, transport, and storage. Flexible bags 110 may be made from a variety of plyable material, such as high density polyethylene (HDPE), paper, cloth, plastic, nylon, fabric, and corn resin material. The flexible nature of the material(s) used to form the bag 110 allows the bag 110 to collapse without the use of the support structure 122. Flexible bags 110 made from HDPE and other disposable materials can be used as trash bags in both indoor and outdoor settings. The flexible material may be a material that is substantially impervious to water or other liquids. Accordingly, the assembly 100 could be used as a disposable collector of trash that may include liquids or liquid-soaked items, and the liquids would be fully contained within the bag's interior cavity 120.

The assembly 100 in alternate embodiments can be made from various materials and/or can have various characteristics, sizes, and shapes. For example, in selected embodiments the bag 110 can be made from a breathable material, a water resistant material, a material providing odor control, or a combination of materials. In selected embodiments, at least a portion of the assembly 100 can be configured to be recyclable and/or combustible (e.g., for incineration). For example, the bag 110 and the support structure 122 can be made from a biodegradable corn resin or other material that breaks down or disintegrates in a landfill relatively quickly. In other embodiments, various portions of the assembly 100 can be made from recyclable materials such as metal, plastic, and the like.

In one embodiment, the stiffeners 126 are made from a substantially planar piece of polymeric or cardboard material. The stiffeners 126 of one embodiment have a height in the range of approximately 2-18 inches, inclusive, and more preferably in the range of approximately 4-10 inches, inclusive. In one embodiment, the stiffeners 126 have a height in the range of approximately 6-8 inches. The stiffeners 126 can be flat, smooth, planar members. In another embodiment, the stiffeners 126 are corrugated members with alternating ridges and troughs oriented parallel to the longitudinal axis of the bag 110. In yet another embodiment, the corrugated stiffeners 126 can be perforated to reduce stiffeners' bending stiffness (which increases foldability) while still maintaining axial rigidity. The corrugation allows the stiffeners 126 to be made from a thinner, lighter weight material while maintaining the structural integrity of the stiffeners. In one embodiment, the stiffeners 126 are corrugated before being attached to the sidewalls 116, and in other embodiments, the stiffeners may be corrugated while attached to the sidewalls.

The stiffeners 126 may be made from other sufficiently durable materials such as, but not limited to, textile material (natural or synthetic), hemp, paper, posterboard, molded pulp, recycled paper, metal, stiff fabric, foam, or a combination of materials. In other embodiments, the stiffeners 126 may include stiff material along one edge portion, such as the lower edge portions 130, and more pliable material along the other edge portion, such as the upper edge portions 132, to facilitate closing a partially filled or filled apparatus 100. The stiffeners 126 may be prefabricated and adhesively attached to the bag 110 using a mechanism for attachment 128. The stiffeners 126 may be attached to the collapsible sidewalls 116 on an interior surface, an exterior surface, or both, and in multiple locations. The stiffeners 126 may be physically independent of each other, and in another embodiment, the stiffeners may be integrally connected to each other. In one embodiment, the stiffeners 126, such as the interconnected stiffeners, may extend around less than the entire circumference or perimeter of the bag 110, so that a space of a selected size can be provided between two end stiffeners. Perforations, fold lines, or the like can be provided that separate the stiffeners while reducing bending stiffness and increasing foldability. In one embodiment, the stiffeners may be positioned proximate to a top portion of the collapsible sidewall, and the top portion is folded over onto itself and heat sealed or otherwise secured in place to form an enclosed portion. Accordingly the stiffeners are positioned in the enclosed portion.

The mechanism for attachment 128 allows the stiffeners 126 to be integrated with the collapsible sidewalls 116. Additionally, the mechanism for attachment 128 provides for attaching the stiffeners 126 in multiple different orientations, patterns, and locations on the collapsible sidewalls 116. In one embodiment, the mechanism for attachment 128 may be an adhesive material that can be applied to a back side of the stiffeners 126 or to a surface of the sidewalls 116. An example of an adhesive product that will bond to HDPE is Adhesive Technologies' Formula 2970. In another embodiment, the mechanism for attachment 128 may comprise tape, mechanical fastening members, mechanical bonding agents, or chemical bonding agents. In a further embodiment, the mechanism for attachment 128 may include heat sealing the stiffeners 126 onto or within a portion of the collapsible sidewalls 116. It will be understood by one of ordinary skill in the art that any mechanism that allows the stiffeners 126 to be coupled or otherwise attached to the collapsible sidewalls 116 may be used as a mechanism for attachment 128.

Figure 1B:
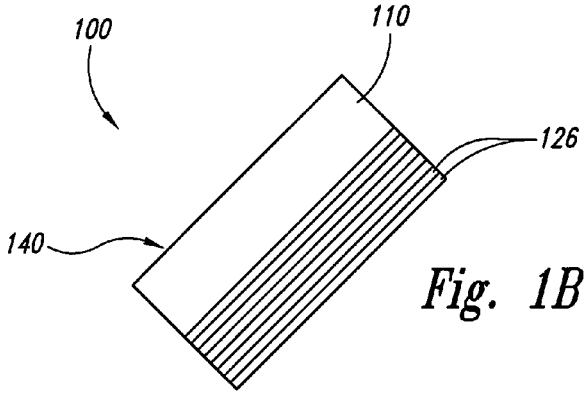
FIG. 1B is an isometric view of the expandable bag assembly of FIG. 1A in a folded configuration.

FIG. 1B illustrates the expandable bag assembly 100 of FIG. 1A when the assembly 100 is fully collapsed and folded to a compact size. When the bag is folded, the stiffeners 126 are aligned to compress to a compact stack 140 and/or form an essentially packed configuration in the illustrated storage configuration.

Figure 2:
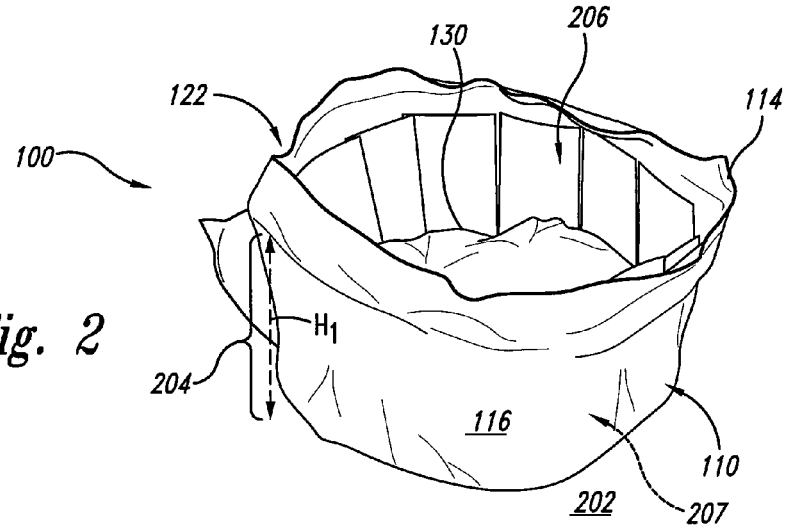
FIG. 2 is an isometric view of the expandable bag assembly of FIG. 1A in a self-supporting, open position.
Figure 3:
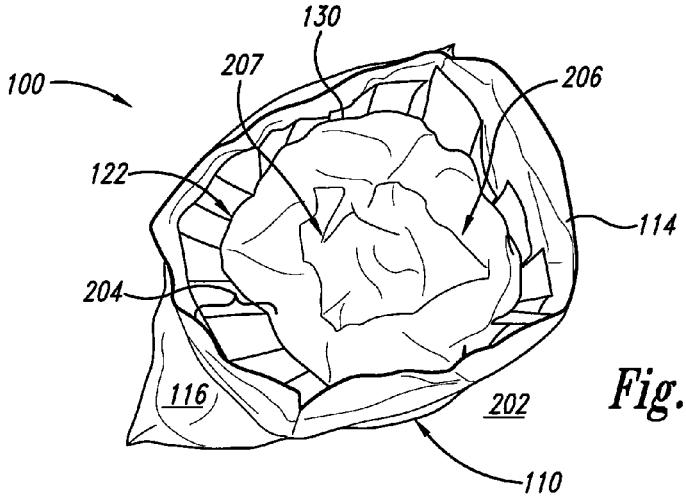
FIG. 3 is a top view of the expandable bag assembly of FIG. 2.

FIG. 2 shows an isometric view and FIG. 3 shows a top view of the expandable bag assembly 100 of FIG. 1A in a self-supporting, open position. In the illustrated embodiment, the support structure 122 allows the open end 114 of the bag 110 to be lifted away from a resting surface 202, such as the ground, a floor, a countertop, or the contents of the bag 110 when partially filled or filled. The support structure 122 provides stiff reinforcement for holding the mouth 118 of the bag 110 in an expanded, open configuration. The support structure 122, when expanded with the collapsible sidewalls 116, provides a vertical wall 204 that defines an upper fillable volume 206 between the resting surface 202 and the top of the vertical wall 204. The collapsible sidewalls 116 below the vertical wall 204 and the upper fillable volume 206 define a lower fillable volume 207.

As illustrated in FIG. 2, the bottom edge portions 130 of the stiffeners 126 form a base for the vertical wall 204. The bottom edge portions 130 may be supported by the resting surface 202 such that the stiffeners 126 are self-supporting in an open position that allows for easy loading of material into at least the second fillable volume.

In the illustrated embodiment, the height $H_1$ of the vertical wall 204 is less than or equal to the overall length of the bag $L_1$. The height $H_1$ of the vertical wall 204 may be determined by the height of the individual stiffeners 126. Alternatively, the height $H_1$ of the vertical wall 204 may be determined by the combined heights of a subset of stiffeners 126 attached to the collapsible sidewalls 116. In this embodiment, the height $H_1$ of the vertical wall 204 depends on the number of aligned stiffeners 126 and their respective heights.

Figure 4B:
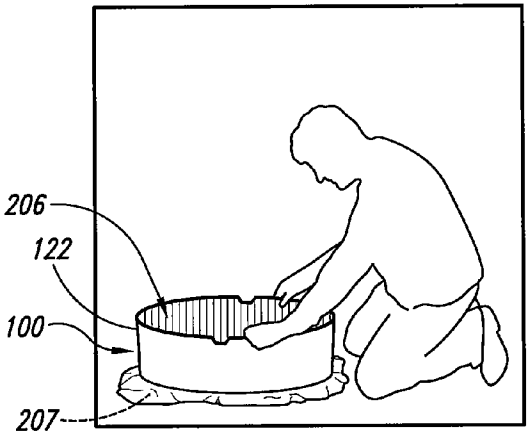
FIG. 4B is an isometric view of the expandable bag assembly of FIG. 2 in a self-supporting, open position.
Figure 4D:
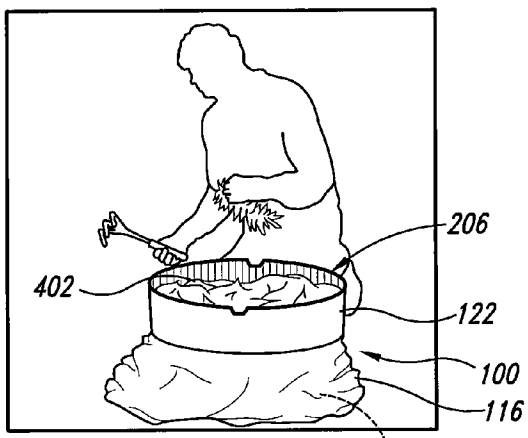
FIG. 4D is an isometric view of the expandable bag assembly of FIG. 4B wherein the support structure sits on the contents and provides an upper fillable volume.
Figure 4A:
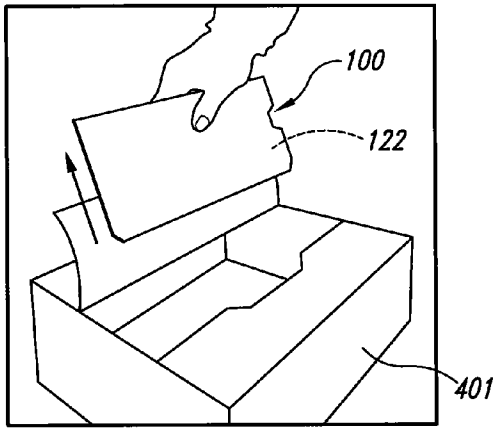
FIG. 4A is an isometric view of a plurality of folded bag assemblies in a dispenser.
Figure 4C:
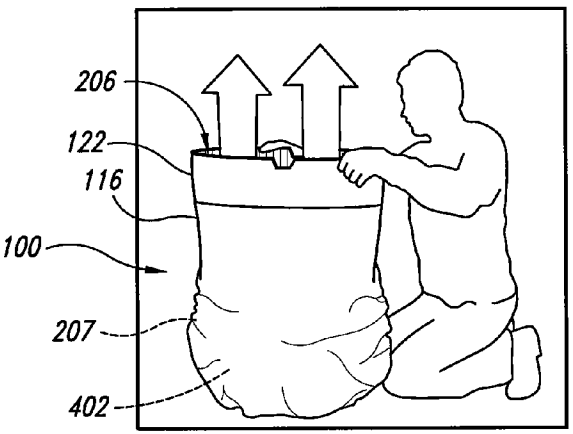
FIG. 4C is an isometric view of the expandable bag assembly of FIG. 4B wherein the support structure is lifted to redistribute contents into a lower fillable volume of the bag assembly.

In certain embodiments, the assembly 100 is disposable and configured to receive and contain trash, recyclables, yard waste or other refuse. In other embodiments, the assembly 100 may be used for storage or transport of non-trash items. FIGS. 4A-4D demonstrate an operative filling of the upper and lower volumes 206 and 207 of the assembly 100. FIG. 4A illustrates a plurality of expandable bag assemblies 100 folded and packaged in a dispenser 401. An expandable bag assembly 100 is removed from the dispenser 401 (FIG. 4A), unfolded, and opened (FIG. 4B). When the bag assembly 100 is in the open position, the support structure 122 holds the mouth of the bag open. In the illustrated embodiment, the support structure 122 is adjustable so the user can adjust the shape of the mouth of the bag while putting contents into the upper fillable volume 206. For example, the support structure 122 can be positioned to hold the mouth of the bag in an open circular shape. In other embodiments, the support structure 122 can be positioned to hold the mouth of the bag in other shapes, such as a generally square, rectangular, oval, elliptical, other polygon, geometric, or non-geometric shape.

After the upper fillable volume 206 is filled or partially filled with the contents 402, the user can lift the support structure 122 upwardly (FIG. 4C), thereby allowing the contents 402 of the upper fillable volume 206 to be redistributed downwardly into the lower fillable volume 207. The user can then lower the open support structure 122 (FIG. 4D) so as to rest upon the contents 402 within the lower fillable volume 207, while the support structure continues to hold the mouth open. In one embodiment, the support structure 122 can be adjusted to change its shape to better sit atop the contents. For example, the support structure can be repositioned from an initial circular shape to a non-circular shape, such as a partial or modified hourglass shape. In this adjusted shape, at least a portion of the support structure 122 can sit atop the redistributed contents, whereby the now-empty upper fillable volume is ready to accept additional material. When the assembly 100 has been filled or partially filled, the entire assembly 100 can be closed and its contents 402 can be stored or thrown away, recycled, or otherwise disposed of quickly, cleanly and easily as a unit.

Figure 5:
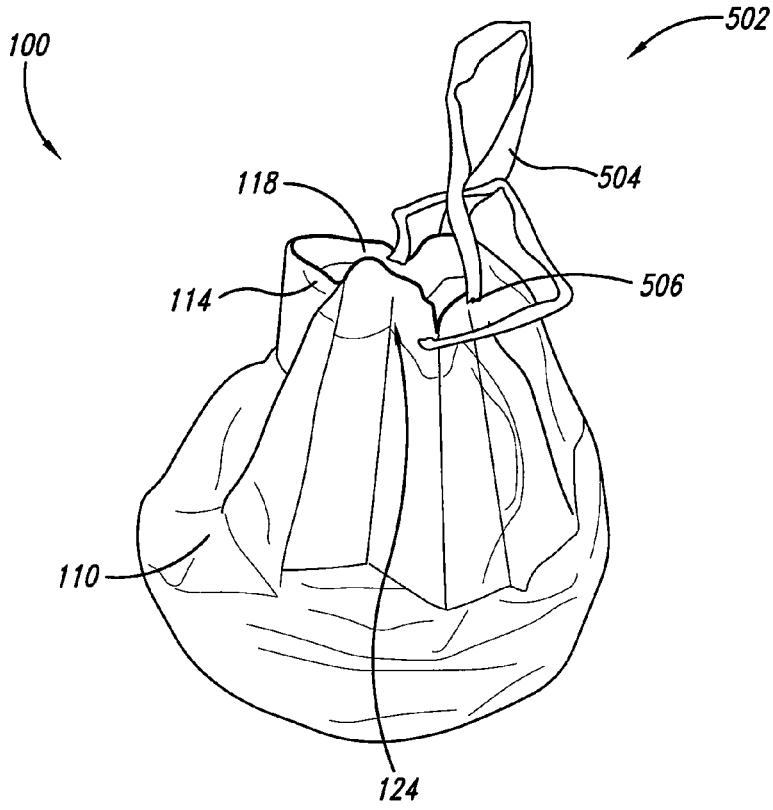
FIG. 5 is an isometric view of the expandable bag assembly of FIG. 4D in a closed position and including an embodiment of a closure device.

The assembly 100, as shown in FIG. 5, includes a closure device 502 integrally connected to the collapsible sidewalls 116 proximal to the open end 114 of the bag 110. The closure device 502 allows the assembly 100 to be securely closed, thereby retaining the contents 402 within the assembly 100. In the illustrated embodiment of FIG. 5, the closure device 502 is a strip of material 504 that has been heat-sealed into a portion 506 of the bag perimeter 124 near the mouth 118. The strip of material 504 may be used as a drawstring to cinch the open end 114 of the bag 110 and close the mouth 118. In some instances, the drawstring may be tied to secure the mouth 118 in the closed position. In other embodiments, the closure device 502 may include a fastener (not shown) with various configurations. The closure device 502 may be separate from the assembly 100 and configured to be connected when desired. For example the closure device 502 may be a fastener such as, but not limited to, a twist-tie, string, ribbon, twine, wire, an adhesive, tape, a pair of corresponding hook and loop strips, rubberband, or the like. In another embodiment, the closure device can be a zipper type closure, a zip-lock type closure, a peel-and-seal type closure, or other press-and-seal type closures. In operation, a user may pull the open end 114 of the bag 110 together and use any restrictive element to secure the mouth 118 in a closed position.

Figure 6:
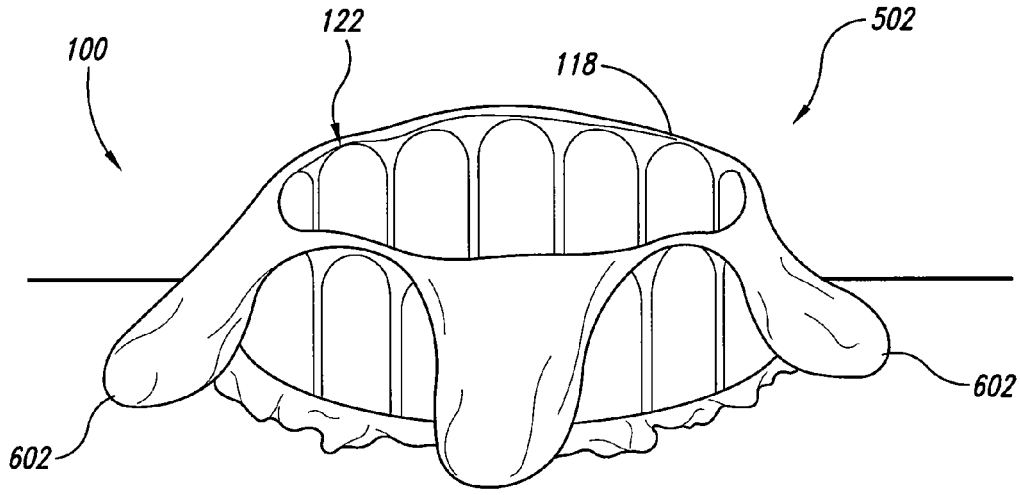
FIG. 6 is an isometric view of an assembly in accordance with the present invention including an additional embodiment of a closure device.

In a further embodiment, shown in FIG. 6, the assembly 100 may include elongated flaps 602 near the open end 114 of the bag 110. The flaps 602 are configured to fold over the support structure 122 so the flaps will not interfere when a user is placing material into the bag through the open mouth. The flaps can also be tied together in a knot (not shown) above the support structure 122 for closing and securing the mouth 118 to retain the contents 402 in the internal cavity 120.

Figure 7:
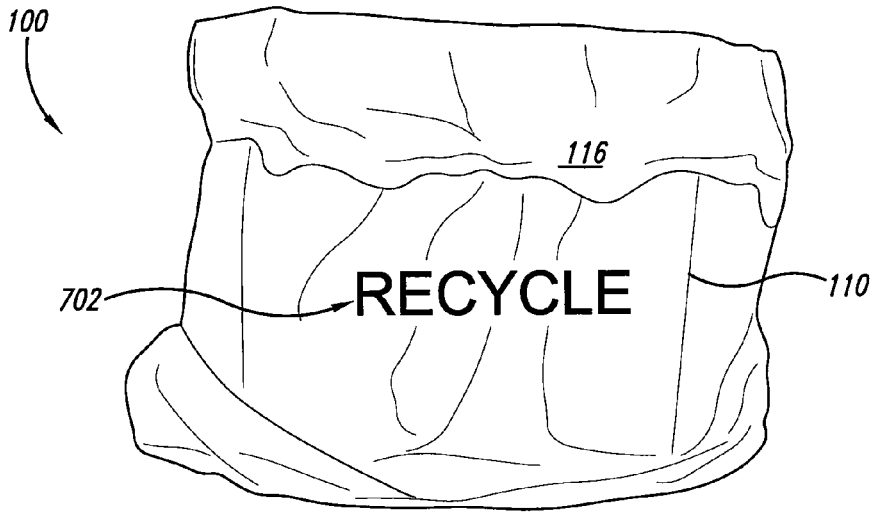
FIG. 7 is an isometric view of an additional embodiment of an assembly in accordance with the present invention.

FIG. 7 is an isometric illustration of an expandable bag assembly 100 of another embodiment having a construction generally similar to the embodiments described above. In addition, the collapsible sidewalls 116 of the bag 110 include a printed marking and/or a labeling area 702. The printed marking 702 can include text images, designs, indicia symbols, logos or other markings. The collapsible sidewalls 116 can be constructed of a flexible material, such as plastic, paper, or the like onto which the markings 702 can be directly printed or applied thereto. In another embodiment, not shown, the stiffeners 126 may include printed marking, labeling areas, or be attached in a recognizable pattern, such as text images, designs, indicia symbols, logos or other markings. In one embodiment, the printed markings 702 include information (e.g. text and/or images) associated with an intended designated use of the assembly 100. In another embodiment, the markings 702 can include advertising and/or a decorative design (e.g., a seasonal decorations scheme). In one embodiment, the stiffeners 126 may be attached to the collapsible sidewalls 116 and shaped to form letters, logos, designs, and/or other patterns on the bag 110.

Figure 8:
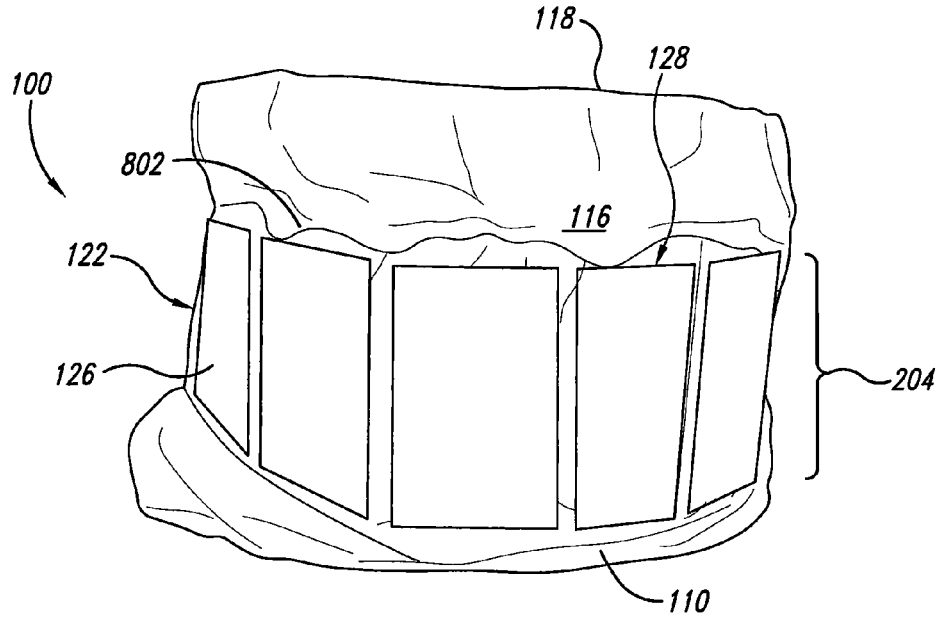
FIG. 8 is an isometric view of a further embodiment of an assembly in accordance with the present invention.

In another embodiment of the expandable bag assembly 100 illustrated in FIG. 8, the support structure 122 is coupled to an exterior surface 802 of the collapsible sidewalls 116. In the illustrated embodiment, the stiffeners 126 are attached to the exterior surface 802 such that the rigidity provided by the plurality of stiffeners 126, in combination with the collapsible sidewalls 116, form a vertical wall 204 for maintaining the mouth 118 of the apparatus 100 in an open, fillable position. The support structure 122 of the illustrated embodiment includes a mechanism for attachment 128 of the stiffeners 126 to the exterior surface. The mechanism for attachment 128 may be similar to those discussed above in accordance with other embodiments. Likewise, the characteristics, size, and shape, and material used to form the stiffeners 126 are not limited to those shown in the illustrated embodiment, but may include the forms and features discussed above and below in accordance with other embodiments.

The stiffeners 126 can all have the same shape. Alternatively, the stiffeners 126 on a bag can have more than one shape or more than one characteristic. FIGS. 9-13 illustrate several possible embodiments of shape, type, and arrangement of the plurality of stiffeners 126. It will be understood by those of ordinary skill in the art that FIGS. 9-13 illustrate only a few of the possible shapes and arrangements of the plurality of stiffeners 126. Reference may be made to FIGS. 1-8 to illustrate the apparatus 100 in greater detail, but does not limit the scope of possibilities illustrated in FIGS. 9-13.

Figures 9A, 9B, 9C, 9D, 9E, 9F:
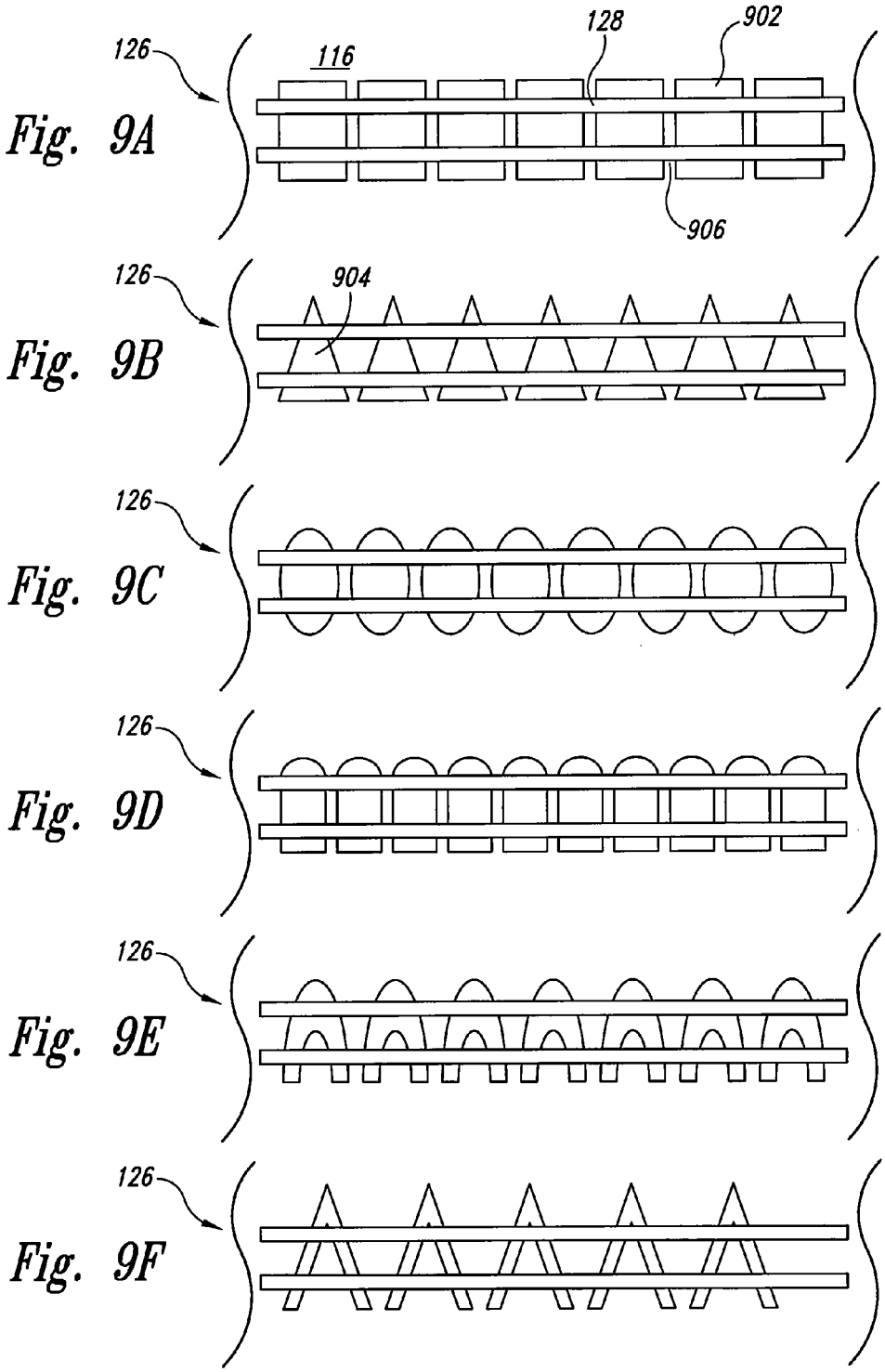
FIG. 9A-9F are front views illustrating embodiments of the plurality of stiffeners in accordance with the present invention.

In one embodiment, illustrated in FIG. 9A, the stiffeners 126 are rectangles 902 and the support structure 122 may be constructed by aligning the plurality of rectangles 902 spaced apart generally side-by-side. FIG. 9B illustrates another embodiment in which the stiffeners 126 are triangles 904 or other shapes, wherein the bottom portion of the stiffener is wider than the top portion. Accordingly, the top edge portions of the stiffeners are spaced further apart from each other than the bottom edge portions. As seen in FIGS. 9A-9F, it will be appreciated by one of ordinary skill in the art that the stiffeners 126 may have any one of a variety of shapes including polygons, ovals, arches, ellipses, superellipses, annuli, hearts, or other geometric shapes. The stiffeners 126 on the bag can all have the same shape. In another embodiment, the stiffeners 126 on the same bag can have different shapes and/or sizes.

In some embodiments, as illustrated in FIG. 9A-9F, the stiffeners 126 are attached to the collapsible sidewalls 116 leaving intervening gaps 906. The stiffeners may be interconnected by one or more lengths of material 908 that can provide lateral stability to the stiffeners across the intervening gaps relative to each other. The intervening gaps 906 may allow the apparatus 100 to fold to size no larger than a target size of a folded section of the bag 110 (as shown in FIG. 1B). As such, the apparatus 100 may be folded to a compact size while preventing problems created with memory folds in the support structures 122. In other embodiments, the stiffeners 126 may be spaced relative to each other so as to minimize interference when closing and securing the mouth 118 of the bag 110 with the closure device 502.

Figure 10A:
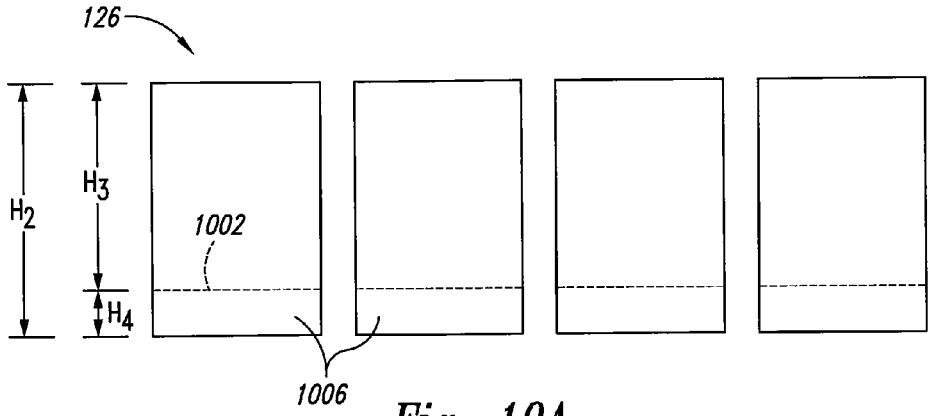
FIG. 10A-10C are front and side views illustrating an additional embodiment of the plurality of stiffeners in accordance with the present invention.
Figure 10B:
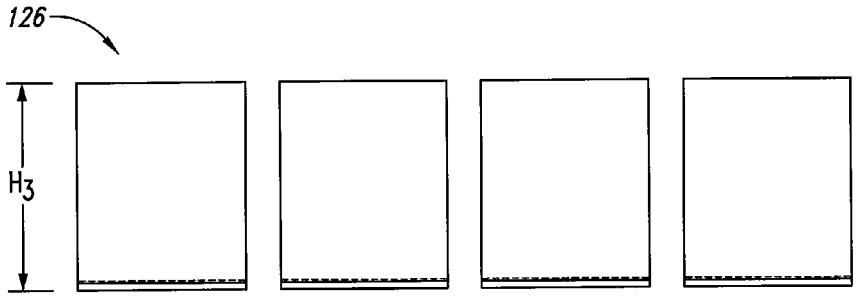
Figure 10C:
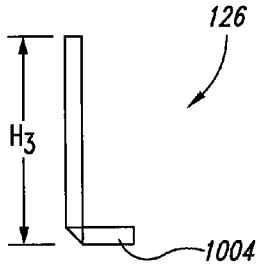
Figure 11:
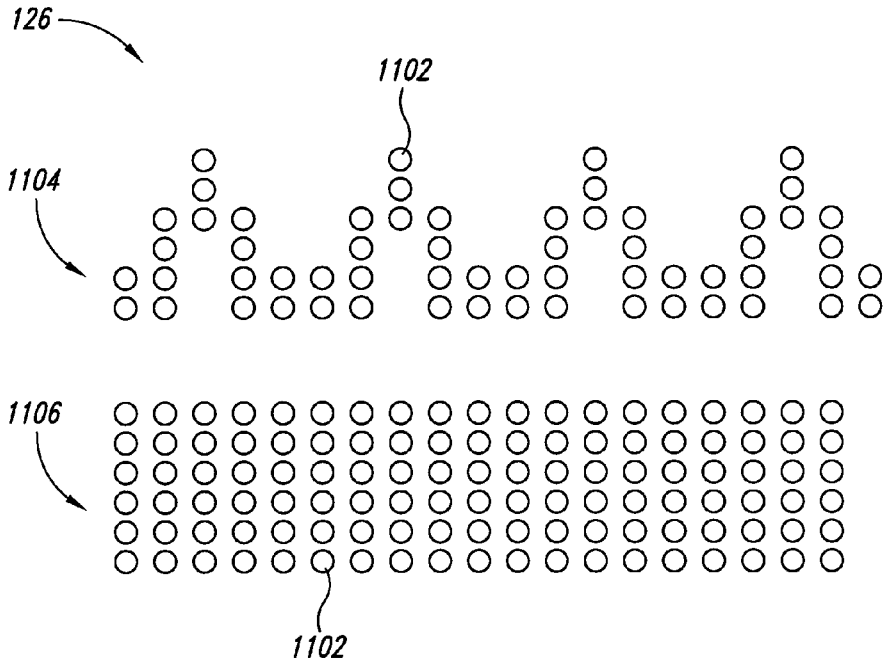
FIG. 11 is a front view illustrating a further embodiment of the plurality of stiffeners in accordance with the present invention.

FIG. 10A-10C illustrates another embodiment in which the stiffeners 126 having a height $H_2$ may include living hinges 1002 or otherwise be foldable for folding the stiffeners 126 to a desirable height $H_3$ or for providing integrated feet 1004 for additional stability of the support structure 122. As used herein, "living hinge" means a hinge that includes no moving parts, such as a thin section of the material that bends to allow movement. In this embodiment, the living hinges 1002 may be positioned at a height $H_4$ to allow a lower portion 1006 of the stiffeners 126 to bend horizontally. In the illustrated embodiment of FIG. 10B, the support structure 122 will provide a vertical wall 204 with height $H_3$. Although this embodiment may be useful in a variety of environments, it may be particularly useful for outdoor trash bag assemblies 100, especially when windy.

In a further embodiment, the stiffeners 126 may comprise a plurality of stiff portions coupled to the bag 110 in a non-continuous arrangement. In the illustrated embodiment of FIG. 11, a plurality of dots 1102 of stiffener material can be applied in a pattern 1104, 1106 around the perimeter 124 of the bag 110. For example, the support structure 122 provided around the perimeter 124 of the bag 110 may be configured for application using high speed manufacturing techniques. In a high-speed manufacturing environment where HDPE bags are "blown" into shape, there are a variety of ways to create these strategically designed and spaced patterns 1104, 1106. In one embodiment, a stiffener material may be sprayed, rolled, or otherwise applied to the collapsible sidewalls 116 in a liquid or other flowable form that subsequently hardens or cures into a rigid material. In some embodiments, the stiffener material may be comprised of a polymer containing liquid, an adhesive component, and a hardener component. The stiffener material may be sprayed or applied in any desired pattern (e.g. patterns 1104, 1106) and on either the interior or the exterior surface of the collapsible sidewalls 116. In one embodiment, the pattern 1104, 1106 may be formed to create text, logos, or otherwise designs.

Figure 12:
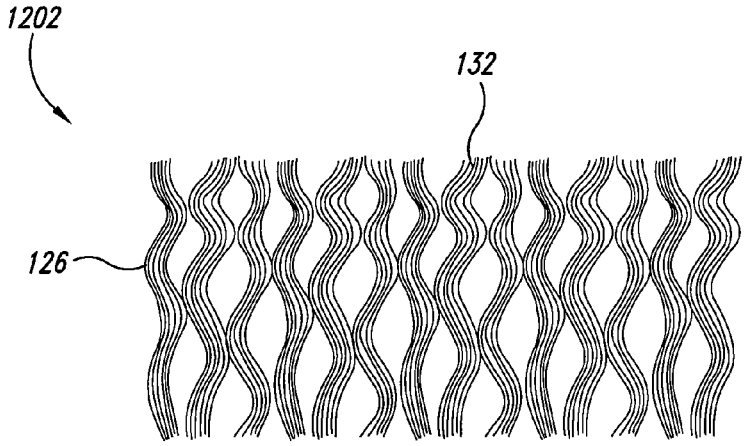
FIG. 12 is a front view illustrating yet another embodiment of the plurality of stiffeners in accordance with the present invention.

FIG. 12 shows an embodiment wherein the stiffeners 126 are interwoven or positioned to form a mesh 1202 around the perimeter 124 of the bag 110. Beneficially, the mesh 1202 arrangement provides vertical axial support to maintain a vertical wall 204 in addition to foldability in a horizontal plane for packaging, storage, and transport. Additionally, when closing and securing the mouth 118 of a full or partially full apparatus 100, the mesh 1202 of the support structure 122 accommodates the cinching of the open end 114 through compression of the stiffeners 126 along the upper edge portions 132.

Figure 13A:
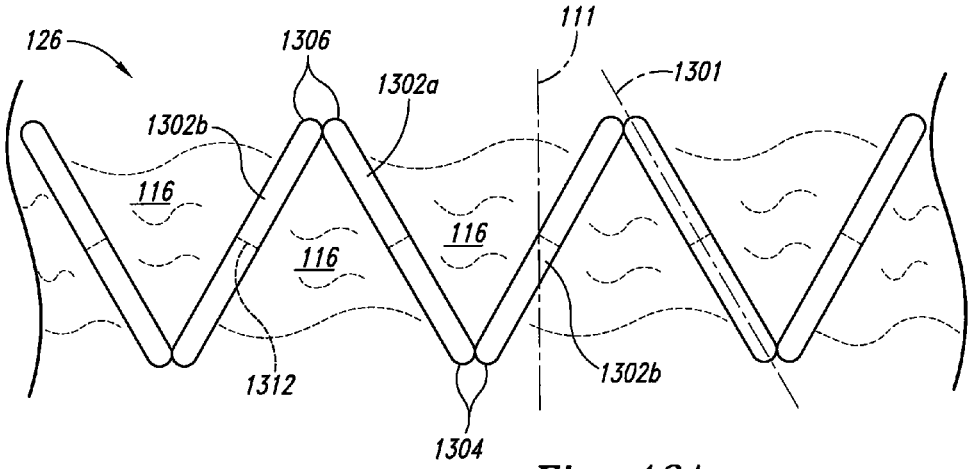
FIG. 13A-13C are front views of another embodiment of the plurality of stiffeners in accordance with the present invention.
Figure 13B:
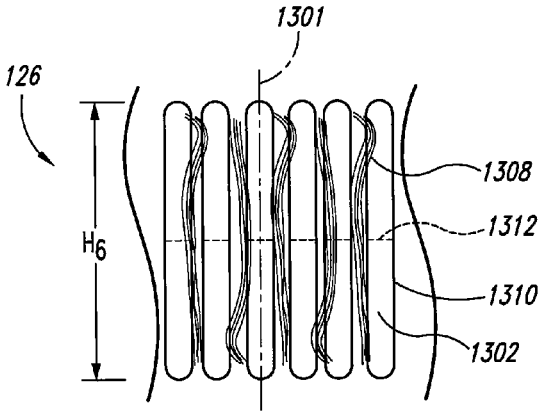
Figure 13C:
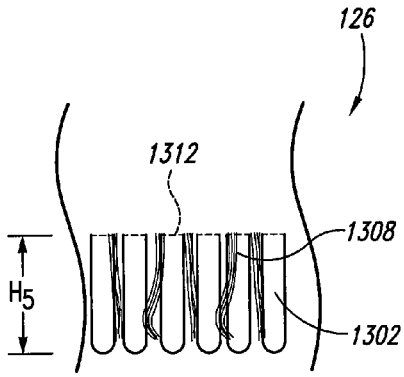

The flexible bag 110 of the embodiments discussed above has a longitudinal axis 111 (FIG. 1) generally oriented through the bag's mouth 118 and closed end 112. The illustrated stiffeners 126 of FIGS. 1-10 also have a longitudinal axis generally parallel to the bag's longitudinal axis when the bag is in an unfolded, deployed position. FIGS. 13A-13C illustrate another embodiment of the support structure 122 in accordance with the present invention. In the illustrated embodiment, the stiffeners 126 are elongated members each having a longitudinal axis 1301. The stiffeners 126 are oriented on the collapsible sidewalls 116 such that their longitudinal axes 1301 are skewed (e.g., not parallel) to the longitudinal axis of the bag 110. Accordingly, the stiffeners 126 are slanted members relative to the bag 110.

In the illustrated embodiment, each stiffener 126 is oriented so its longitudinal axis 1301 is also skewed relative to the longitudinal axes of the immediately adjacent stiffeners. The stiffeners 126 are attached to the collapsible sidewalls 116 at alternating angles providing a vertical wall 204 between a lower edge 130 and an upper edge 132 of the stiffeners 126. The stiffeners 126 may be aligned such that every two stiffeners 126 create a "V" shape for vertical structural support. Accordingly, the stiffeners 126 are positioned in a zig-zag pattern around the perimeter of the bag 110, such as around the mouth 118 of the bag. In another embodiment, the stiffeners 126 can be oriented so their longitudinal axes 1301 are parallel to each other but skewed relative to the bag's longitudinal axis 111.

As shown in FIG. 13B, the mouth 118 of the bag 110 can be cinched closed and the slanted stiffeners 126 can rotate (with a position of the flexible side wall 116), so as to be parallel and immediately adjacent to each other. Accordingly, the mouth 118 of the bag 110 can be collapsed and cinched closed to contain the contents within the bag for disposal, storage, etc.

Additionally, some embodiments may include folds or living hinges 1312 in the stiffeners 126. The living hinges 1312 can be formed by creases or fold lines integrally formed in the stiffeners 126. Alternatively, the stiffeners 126 may comprise multiple layers and the living hinge 1312 may be formed by a cut in a plurality of the layers, while other layers are uncut. The living hinges 1312, as shown in the illustrated embodiment of FIG. 13C, are horizontal folds that operatively allow the stiffeners 126 to fold back on themselves to a height $H_5$ smaller than a height $H_6$ of the full-length stiffener. As seen in FIG. 13A, the living hinges 1312 are not perpendicularly aligned with the longitudinal axis 111 of the bag 110 when the slanted stiffeners 126 are in a fully expanded configuration, thereby preventing the living hinges 1312 from prematurely folding and compromising the integrity of the support structure 122 while the mouth 118 of the bag 110 is open. In one embodiment the living hinges 1312 are one-way hinges that bend toward the center of the apparatus 100 minimizing interference when closing the mouth 118 of the bag 110. In another embodiment, the living hinges 1312 are two-way hinges.

Figure 14:
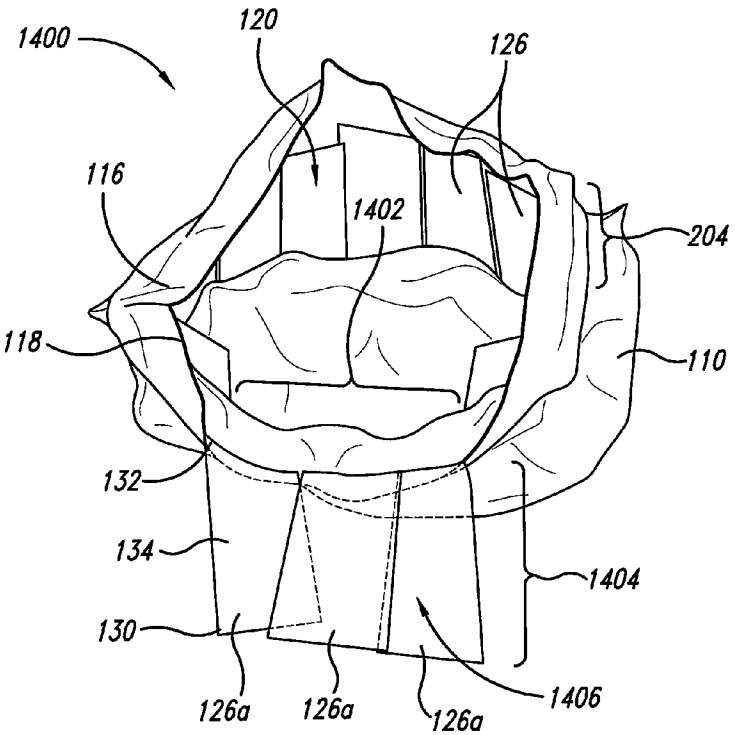
FIG. 14 is an isometric view of a further embodiment of an expandable bag assembly in accordance with the present invention.

In another embodiment of the expandable bag assembly 100 illustrated in FIG. 14, one or more of the stiffeners 126 may be securely attached to the collapsible sidewalls 116 only along their upper portions (i.e., near the upper edge portions 132) such that their lower portions and lower edge portions 130 may move relative to the collapsible sidewalls 116. In one embodiment, the lower portions of the stiffeners 126 can be releasably attached to the bag's sidewalls 116. In these embodiments, one or more of the stiffeners 126 may be flipped over the mouth 118 of the bag 110 and/or substantially aligned at an angle relative to the other. In the illustrated embodiment, stiffeners 126*a* have been flipped out to create a gap 1402 in the vertical wall 204, which may facilitate filling the internal cavity 120 of the bag 110 in some instances. In the illustrated embodiment, the stiffeners 126*a* may provide a slideable ramp 1406 for content to be swept or otherwise moved onto. In this embodiment, the stiffeners 126*a* may be adapted to provide an integrated "dustpan" structure 1404 when desired by a user.

In reference to FIGS. 1-8 and 14, the support structure 122 may be attached to the perimeter 124 of the bag 110 providing an extra upper portion of the flexible bag 110 above the upper edge portions 132 of the plurality of stiffeners 126. The extra upper portion of the bag 110 may be used, in conjunction with a closure device 502, to close the bag 110 without being adversely encumbered by the stiffeners 126. Alternatively, the extra upper portion of the bag 110 may be used to secure the expandable bag apparatus 100 on a trash can or other frame support (not shown) in traditional fashion. In another embodiment, the support structure 122 and the flexible bag 110 may expand to a perimeter greater than a trash receptacle such that the closed end 112 of the flexible bag 110 may be enclosed in the trash receptacle while the support structure 122 surrounds an upper rim of the receptacle securing the apparatus 100 to the receptacle and/or providing additional filling volume above the volume of the receptacle.

In a further embodiment, a portion of the flexible bag 110 above the support structure 122 and including the bag's open end 114 may have a greater circumference than the vertical wall 204. The open end 114 of the bag 110, in this embodiment, may be splayed out from the vertical wall 204 and provide a skirt for the apparatus 100. Disposed contents that escape the internal cavity 120 of the apparatus 100 and fall to the skirt, may be easily received into the internal cavity 120 by lifting on the outer perimeter of the mouth 118 of the bag 110 above the height $H_1$ of the vertical wall 204. For example, when closing the mouth 118 of the bag 110, contents remaining outside the internal cavity 120 and caught by the skirt will be dropped into the internal cavity 120 during the lifting, cinching, and securing of the mouth 118.

In one aspect, at least some of the stiffeners 126 may be removeably and/or repositionably attached to the bag. The apparatus 100 may be configured so the stiffeners 126 can be repositioned to allow a shift in the structural integrity of one or more portions of the vertical wall 204. In one embodiment, one or more stiffeners 126 may be removed to reduce the height $H_1$ of the vertical wall 204 in one or more locations. In a further embodiment, one or more stiffeners 126 may be moved to an alternate location to provide additional structural reinforcement in some areas of the vertical wall 204. One or more stiffeners 126 may also be moved to reduce the height $H_1$ of the vertical wall 204 in one or more locations while increasing the height $H_1$ of the vertical wall 204 in other locations. In this manner, the user may adapt the apparatus 100 to any one of a multiple of structural arrangements depending on immediate and/or future functional needs or preference.

It will be appreciated by one of ordinary skill in the art that the apparatus 100 may be sized to appropriately fit a variety of locations or space restrictions. For example, the apparatus 100 may be the size of a large trash bag (e.g. 30 gallons) for outdoor lawn and garden use. Alternatively the apparatus 100 may be sized much smaller to fit, for example, on a kitchen countertop, on a baby-changing table, in a vehicle, or in another location. The apparatus 100 may also be sized and adapted for use in gardening, such as to contain soil during the process of potting plants. In a further embodiment, the bag apparatus 100 may be inverted over items for protection, such as protecting plants against frost. In this manner, the upper edge portions 132 of the stiffeners 126 may sit on or be anchored to a resting surface (e.g. the ground) while the flexible bag covers the desired items.

The expandable bag apparatus 100 may also be made out of non-disposable materials and be used as laundry bags, storage bags, dry-cleaning bags, transport bags, and the like. Furthermore, the type, strength, elasticity, and thickness of material used to make the flexible bag 110 and the support structure 122 may be adapted to accommodate contents of various weight and texture to prevent tearing of the bag 110 and allow the filled apparatus 100 to be transported and/or disposed.

Figure 15:
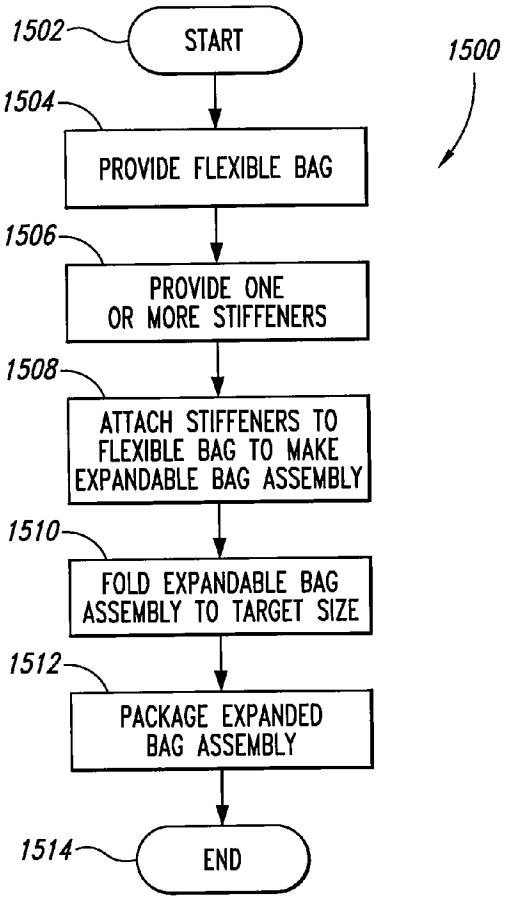
FIG. 15 is a schematic flow chart diagram illustrating one embodiment of a method for making an expandable bag assembly in accordance with the present invention.

The schematic flow chart diagram set forth in FIG. 15 is generally set forth as a logical flow chart diagram. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

FIG. 15 illustrates one embodiment of a method 1500 for making an expandable bag assembly in accordance with the present invention. The method 1500 may begin 1502 and may include providing 1504 a flexible bag with a closed and open ends and collapsible sidewalls, providing 1506 a support structure with a plurality of stiffeners, and attaching 1508 the stiffeners to the flexible bag such that the support structure is integrated with the flexible bag and provides a vertical wall for filling the bag. The method 1500 may further include folding 1510 the expandable bag assembly to target size. The method 1500 may also include packaging 1512 the expanded bag assembly. The method 1500 may end 1514 following steps 1508, 1510, 1512. Reference may be made to FIGS. 1-14 to illustrate the method 1500 in greater detail, but does not limit the scope of the method 1500.

A feature of some of the embodiments discussed above is that an expandable bag assembly can be folded, rolled, or otherwise compressed for easy packaging, storage and transport. Additionally, in certain embodiments, the assembly may be expanded such that the support structure does not have problems associated with memory folds. Furthermore, the assembly may be provided with a support structure configured to retract during closure of the open end of the bag and prevent user dissatisfaction with torn or pulled bags at or near the mouth of the bag.

From the foregoing, it will be appreciated that specific embodiments of the invention have been described herein for purposes of illustration, but that various modifications may be made without deviating from the invention. Additionally, aspects of the invention described in the context of particular embodiments may be combined or eliminated in other embodiments. Furthermore, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited except as by the appended claims.

The invention claimed is:

1. An expandable bag assembly with support aid for filling the bag assembly comprising:

a flexible bag having a closed end portion, an open end portion, and collapsible sidewalls that define an internal cavity, the open end portion defining a mouth of the bag and being moveable to an open position to receive fill material into the internal cavity and being moveable to a closed position, the collapsible sidewalls being movable between an expanded position and a collapsed position; and a plurality of substantially planar stiffeners attached to the sidewalls around the mouth of the bag, wherein each of the stiffeners is distinct from and adjacent to other ones of the stiffeners and is moveable relative to the adjacent ones of the stiffeners when the mouth of the bag is in the open position, the stiffeners being spaced apart by intervening gaps that allow the bag to be folded to form a substantially planar configuration, the stiffeners including an integral fold line about which the stiffener can be folded, the stiffeners defining a positionable self-supporting structure proximate to the mouth of the bag and configured to define a portion of the internal cavity proximate to the mouth of the bag and to retain the mouth of the bag and the portion of the internal cavity in the open position to receive fill material therein, the self-supporting structure being configured to rest on at least a portion of the collapsible sidewalls in the collapsed position while holding the mouth of the bag in the open position.

2. The assembly of claim 1 wherein each of the stiffeners is moveable with a portion of the flexible bag relative to the adjacent ones of the stiffeners.

3. The assembly of claim 1 wherein the stiffeners are attached to the flexible bag at a position away from the mouth of the bag.

4. The assembly of claim 1 wherein the stiffeners are attached to the flexible bag at a position proximate to the mouth of the bag.

5. The assembly of claim 1 wherein the stiffeners are independently attached to the collapsible sidewalls.

6. The assembly of claim 1 wherein the stiffeners have a bottom portion with a first width and a top portion having a second width different than the first width.

7. The assembly of claim 1 wherein the stiffeners have top and bottom portions, the top portions of adjacent stiffeners are spaced further apart from each other than the bottom portions of the same adjacent stiffeners.

8. The assembly of claim 1 wherein a web formed by a portion of the sidewalls extends between adjacent ones of the plurality of stiffeners.

9. The assembly of claim 1 wherein the stiffeners are corrugated members.

10. The assembly of claim 1 wherein the stiffeners are integrally connected to the sidewalls.

11. The assembly of claim 1 wherein the stiffeners are attached to one of an external surface and an internal surface of the collapsible sidewalls.

12. The assembly of claim 1 wherein the plurality of stiffeners are provided with one or more geometric shapes.

13. The assembly of claim 1 where the flexible bag assembly is foldable with the stiffeners wherein the stiffeners are positionable in a stacked orientation.

14. The assembly of claim 1 wherein the flexible bag has a first longitudinal axis, and the stiffeners have a second longitudinal axis substantially parallel to the first longitudinal axis.

15. The assembly of claim 1 wherein the stiffeners are arranged in a zig-zag pattern.

16. The assembly of claim 1 wherein the flexible bag and the stiffeners are made of one or more recyclable materials.

17. The assembly of claim 1, further comprising a closure device attached to the flexible bag proximate to the mouth and configured to retain the mouth of the bag in the closed position.

18. The assembly of claim 17 wherein the closure device comprises a drawstring integral with the collapsible sidewalls.

19. The assembly of claim 1 wherein the stiffeners are comprised of members formed of at least one of paper, plastic, cardboard, metal, natural textiles, and synthetic textiles.

20. The assembly of claim 1 wherein each of the stiffeners are independent from each other.

21. An expandable bag assembly with support aid for filling the bag assembly comprising:

a flexible bag having a closed end portion, an open end portion, and collapsible sidewalls that define an internal cavity, the open end portion defining a mouth of the bag and being moveable to an open position to receive fill material into the internal cavity and being moveable to a closed position, the collapsible sidewalls being movable between an expanded position and a collapsed position: and a plurality of substantially planar stiffeners attached to the sidewalls around the mouth of the bag, wherein each of the stiffeners is distinct from and adjacent to other ones of the stiffeners and is moveable relative to the adjacent ones of the stiffeners when the mouth of the bag is in the open position, the stiffeners being spaced apart by intervening gaps that allow the bag to be folded to form a substantially planar configuration, the stiffeners defining a positionable self-supporting structure proximate to the mouth of the bag and configured to define a portion of the internal cavity proximate to the mouth of the bag and to retain the mouth of the bag and the portion of the internal cavity in the open position to receive fill material therein, the self-supporting structure being configured to rest on at least a portion of the collapsible sidewalls in the collapsed position while holding the mouth of the bag in the open position, wherein the stiffeners have upper and lower portions, and at least one of the stiffeners includes a living hinge intermediate the upper and lower portion.

22. An expandable bag assembly with support aid for filling the bag assembly comprising:

a flexible bag having a closed end portion, an open end portion, and collapsible sidewalls that define an internal cavity, the open end portion defining a mouth of the bag and being moveable to an open position to receive fill material into the internal cavity and being moveable to a closed position, the collapsible sidewalls being movable between an expanded position and a collapsed position; and a plurality of substantially planar stiffeners attached to the sidewalls around the mouth of the bag, wherein each of the stiffeners is distinct from and adjacent to other ones of the stiffeners and is moveable relative to the adjacent ones of the stiffeners when the mouth of the bag is in the open position, the stiffeners being spaced apart by intervening gaps that allow the bag to be folded to form a substantially planar configuration, the stiffeners defining a positionable self-supporting structure proximate to the mouth of the bag and configured to define a portion of the internal cavity proximate to the mouth of the bag and to retain the mouth of the bag and the portion of the internal cavity in the open position to receive fill material therein, the self-supporting structure being configured to rest on at least a portion of the collapsible sidewalls in the collapsed position while holding the mouth of the bag in the open position, wherein the flexible bag has a first longitudinal axis, and the stiffeners have a second longitudinal axis skewed relative to the first longitudinal axis.

23. An expandable bag assembly with support aid for filling the bag assembly comprising:

a flexible bag having a closed end portion, an open end portion, and collapsible sidewalls that define an internal cavity, the open end portion defining a mouth of the bag and being moveable to an open position to receive fill material into the internal cavity and being moveable to a closed position, the collapsible sidewalls being movable between an expanded position and a collapsed position; and a plurality of substantially planar stiffeners attached to the sidewalls around the mouth of the bag, wherein each of the stiffeners is distinct from and adjacent to other ones of the stiffeners and is moveable relative to the adjacent ones of the stiffeners when the mouth of the bag is in the open position, the stiffeners being spaced apart by intervening gaps that allow the bag to be folded to form a substantially planar configuration, the stiffeners defining a positionable self-supporting structure proximate to the mouth of the bag and configured to define a portion of the internal cavity proximate to the mouth of the bag and to retain the mouth of the bag and the portion of the internal cavity in the open position to receive fill material therein, the self-supporting structure being configured to rest on at least a portion of the collapsible sidewalls in the collapsed position while holding the mouth of the bag in the open position, wherein the stiffeners are formed by a flowable stiffener material applied to the flexible bag and allowed to harden to a stiff condition.

24. The assembly of claim 23 wherein flowable stiffener material is applied to the flexible bag in a pattern to form one of a word, a logo, or a design.

25. A disposable bag assembly, comprising:

a body portion having a first longitudinal axis, an internal cavity, sidewalls and an open end portion that defines a mouth of the bag moveable to an open position to receive fill material into the internal cavity and being moveable to a closed position, the sidewalls being collapsible and movable between an expanded position and a collapsed position; and a plurality of substantially planar stiffeners attached to the sidewalls of the bag proximate to the open end portion, each of the stiffeners being distinct from and adjacent to other ones of the stiffeners, each of the stiffeners having a second longitudinal axis and being moveable with a portion of the flexible sidewall relative to the adjacent ones of the stiffeners when the mouth of the bag is in the open position, the stiffeners being spaced apart by intervening gaps that allow the bag to be folded to form a substantially planar configuration, each of the stiffeners being corrugated with ridges substantially parallel to the second longitudinal axis, the stiffeners forming a conformable, self-supporting structure proximate to the mouth of the bag and configured to rest on at least a portion of the collapsible sidewalls in the collapsed position and to be positionable to retain the mouth of the bag and the portion of the internal cavity in the open position to receive fill material therein, wherein the bag has a first longitudinal axis, and the stiffeners have a second longitudinal axis substantially skewed relative to the first longitudinal axis.

26. The assembly of claim 25 wherein the stiffeners are independently attached to the collapsible sidewalls.

27. The assembly of claim 25 wherein the stiffeners have a bottom portion with a first width and a top portion having a second width less than the first width.

28. The assembly of claim 25 wherein the stiffeners are adhered to the sidewalls.

29. The assembly of claim 25 wherein the stiffeners are integrally connected to the sidewalls.

30. The assembly of claim 25 wherein the stiffeners are attached to one of an external surface and an internal surface of the sidewalls.

31. The assembly of claim 25 wherein the flexible bag and the stiffeners are made of one or more recyclable materials.

32. The assembly of claim 25 wherein the stiffeners are comprised of members formed of at least one of paper, plastic, and cardboard.

33. A disposable bag assembly, comprising:

a body portion having a first longitudinal axis, an internal cavity, sidewalls and an open end portion that defines a mouth of the bag moveable to an open position to receive fill material into the internal cavity and being moveable to a closed position, the sidewalls being collapsible and movable between an expanded position and a collapsed position: and a plurality of substantially planar stiffeners attached to the sidewalls of the bag proximate to the open end portion, each of the stiffeners being distinct from and adjacent to other ones of the stiffeners, each of the stiffeners having a second longitudinal axis and being moveable with a portion of the flexible sidewall relative to the adjacent ones of the stiffeners when the mouth of the bag is in the open position, the stiffeners being spaced apart by intervening gaps that allow the bag to be folded to form a substantially planar configuration, each of the stiffeners being corrugated with ridges substantially parallel to the second longitudinal axis, the stiffeners forming a conformable, self-supporting structure proximate to the mouth of the bag and configured to rest on at least a portion of the collapsible sidewalls in the collapsed position and to be positionable to retain the mouth of the bag and the portion of the internal cavity in the open position to receive fill material therein, wherein each of the stiffeners has an integral living hinge about which the stiffener can move.

34. A disposable bag assembly comprising:

a flexible bag having a closed end and open end, the bag being movable between an expanded position and a collapsed position; and an integrated support structure having a plurality of stiffeners spaced apart from and adjacent to each other, wherein the stiffeners have a grooved texture and are configured to be movable relative to each other while the bag is in the collapsed position and the support structure is holding and maintaining the open end of the bag assembly in a self-supporting open fillable position and wherein the stiffeners are spaced apart by intervening gaps that allow the bag to be folded are further configured to fold with the flexible bag to form a substantially planar configuration such that the stiffeners are aligned to form a compact stack when the bag and stiffeners are in a folded condition, wherein the flexible bag has a first longitudinal axis, and the stiffeners have a second longitudinal axis substantially skewed relative to the first longitudinal axis.

35. The assembly of claim 34 where in the stiffeners are attached to one of an external surface and an internal surface of the collapsible sidewalls.

36. The assembly of claim 34 wherein the flexible bag has a first longitudinal axis, and the stiffeners have a second longitudinal axis substantially parallel to the first longitudinal axis.

37. The assembly of claim 34 wherein the stiffeners are formed by a flowable stiffener material applied to the flexible bag and allowed to harden to a stiff condition.

38. The assembly of claim 34 wherein the stiffeners are corrugated members.

* * * * *